US005311631A

United States Patent [19]

Smith, Jr.

[11] Patent Number: 5,311,631

[45] Date of Patent: May 17, 1994

[54] CLEANING APPARATUS FOR SPAS AND HOT TUBS

[76] Inventor: Cossie L. Smith, Jr., 4469 Firmont Dr. SE., Port Orchard, Wash. 98366

[21] Appl. No.: 964,448

[22] Filed: Oct. 21, 1992

[51] Int. Cl.[5] ..... E04H 3/20

[52] U.S. Cl. ..... 15/1.7; 15/421; 15/144.4; 4/490; 4/546; 210/169; 210/416.2

[58] Field of Search ..... 15/1.7, 421, 144.4; 4/490, 538, 546; 210/167, 169, 416.2

[56] References Cited

U.S. PATENT DOCUMENTS

| | | | |
|---|---|---|---|
| 2,977,613 | 4/1961 | Mikulas | 15/1.7 |
| 3,003,169 | 10/1961 | Forrester | 15/1.7 |
| 3,245,420 | 4/1966 | Cherney | 15/1.7 |
| 3,310,173 | 3/1967 | Sosower | 15/1.7 |
| 3,443,264 | 5/1969 | Miller | 4/490 |
| 4,275,474 | 6/1981 | Woodard | 15/1.7 |
| 4,498,206 | 2/1985 | Braukmann | 15/1.7 |
| 4,737,279 | 4/1988 | Lewis | 210/416.2 |
| 4,740,307 | 4/1988 | Bvelteman | 210/416.2 |
| 4,797,206 | 1/1989 | Lynch | 15/1.7 |
| 5,082,028 | 1/1992 | Jean-Jacques | 15/1.7 |
| 5,100,541 | 3/1992 | Kallenbach | 15/1.7 |

FOREIGN PATENT DOCUMENTS

| | | | |
|---|---|---|---|
| 81811 | 6/1983 | European Pat. Off. | 4/490 |
| 1181483 | 11/1964 | Fed. Rep. of Germany | 15/1.7 |

*Primary Examiner*—Harvey C. Hornsby
*Assistant Examiner*—Gary K. Graham

[57] ABSTRACT

A water driven cleaning apparatus for use in spas, hot tubs and like open-topped enclosures suitable for bathing and having a pressurized water system. This fast, efficient, easy-to-use cleaning system extends the pressurized water system to create vacuum pressure used to remove sand, gravel, leaves, needles and other unwanted foreign matter collected in the vessel. An in-line filter traps these particles and permits removal before they enter the primary filtration system. This apparatus can be used by the bather from inside or outside the vessel. The vessel may be located indoors or outdoors. The apparatus operates without modifying the spa, hot tub or like open-topped enclosure.

3 Claims, 3 Drawing Sheets

CLEANING APPARATUS FOR SPAS AND HOT TUBS

BACKGROUND-FIELD OF THE INVENTION

This invention relates to spas, hot tubs and like open-topped enclosures suitable for bathing and having a pressurized water system, specifically to the removal of sand, gravel, leaves and other particles which collect within spas and hot tubs.

BACKGROUND-DESCRIPTION OF PRIOR ART

The increased use of spas and hot tubs for therapeutic and recreational lounging has created a need for an effective and efficient cleaning system to remove particles which collect within these vessels. These particles include sand, gravel, leaves, needles and other foreign matter which may inadvertently be added to the vessel. Spa and hot tube users appreciate and expect a clean therapeutic soaking environment. Particles trapped in the system create an aesthetic and health concern. The filter built into the circulating system is designed to remove microscopic elements trapped in the water. These filters are not designed to remove the larger, heavier particles which accumulate on the floor and seats of the vessel. These particles may be inadvertently added to the vessel in a variety of ways. These may include:

1. Particles falling from surrounding plants or trees.
2. Wind blown particles which may fall into the vessel.
3. Particles carried inadvertently by the spa or hot tub user on their person or bathing attire.
4. Particles circulated through the filter and returning to the vessel as they work through the system.

The removal of these particles has been attempted in the following ways:

1. An apparatus designed to attach to a garden hose. As water is forced into the apparatus, the water forces particles into a screen which traps the particles.

This particular system has the following disadvantages:

a. Each cleaning requires the addition of cold water into the heated system. This creates a need for additional heating which translates into increased energy consumption and expense.
   b. Each cleaning requires attachment to a garden hose before use. This is an inconvenience and at times, may not be possible.
   c. Use of this apparatus in an indoor setting is not desirable.

2. The second method to remove these particles makes use of a hand-operated pumping apparatus. The following disadvantages are found within this system:
   a. Each pump covers a limited area.
   b. The users physical stamina will be tested as continuous pumping is required to maintain suction.
   c. The user must be wrong to pump with enough force to create the strong suction needed to remove particles.
3. The third method used to remove these particles enlists the use of hydrostatic pressure. The tube-like cylinder requires trapping air within the tube, lowering the tube into the water, release the trapped air. This creates a suction which pulls water and particles into the tube. The following disadvantages are found within this system:
   a. Suction power is limited
   b. Suction time is limited
   c. Weight of apparatus when filled with water is cumbersome and heavy to lift out of vessel.

OBJECTS AND ADVANTAGES

It is an object therefore of the present invention to provide a low-cost, efficient, easy-to-operate cleaning system designed to remove sand, gravel, leaves, needles and other particles which accumulate within spas and hot tubs. This invention may be used indoors, outdoors, within the vessel or outside the vessel.

Accordingly, several objects and advantages of the invention are:

(a) to provide an efficient, easy to operate system to remove sand, gravel, leaves, needles and other foreign matter from spas and hot tubs.
(b) to provide an apparatus which can be used to clean spas and hot tubs in an indoor or outdoor environment.
(c) to provide an apparatus with a in-line filter to remove foreign matter BEFORE this foreign matter enters the primary filtration system. This will increase the life of the primary filter.
(d) to provide a system which does not require the addition of cold water to the vessel in order to be operational.
(e) to provide a system which does not require connection to a hose or faucet to function.
(f) to provide consistent vacuum action within the vessel.
(g) to provide a system which does not require pumping or physical strength to operate.
(h) to provide a system which will provide suction for an extended length of time.
(i) to provide a cleaning system which can be operated from within the vessel.
(j) to provide a cleaning system which can be operated from outside the vessel.
(k) to provide a system which can be operated without modifying or removing parts from the spa or hot tub.

Still further objects and advantages will become apparent from a consideration of the ensuing description and drawings.

BRIEF DESCRIPTION OF THE DRAWINGS

The preferred embodiments of this water driven cleaning apparatus and extension tool are illustrated in the drawings, wherein.

REFERENCE NUMERALS IN DRAWINGS

Figure 1:
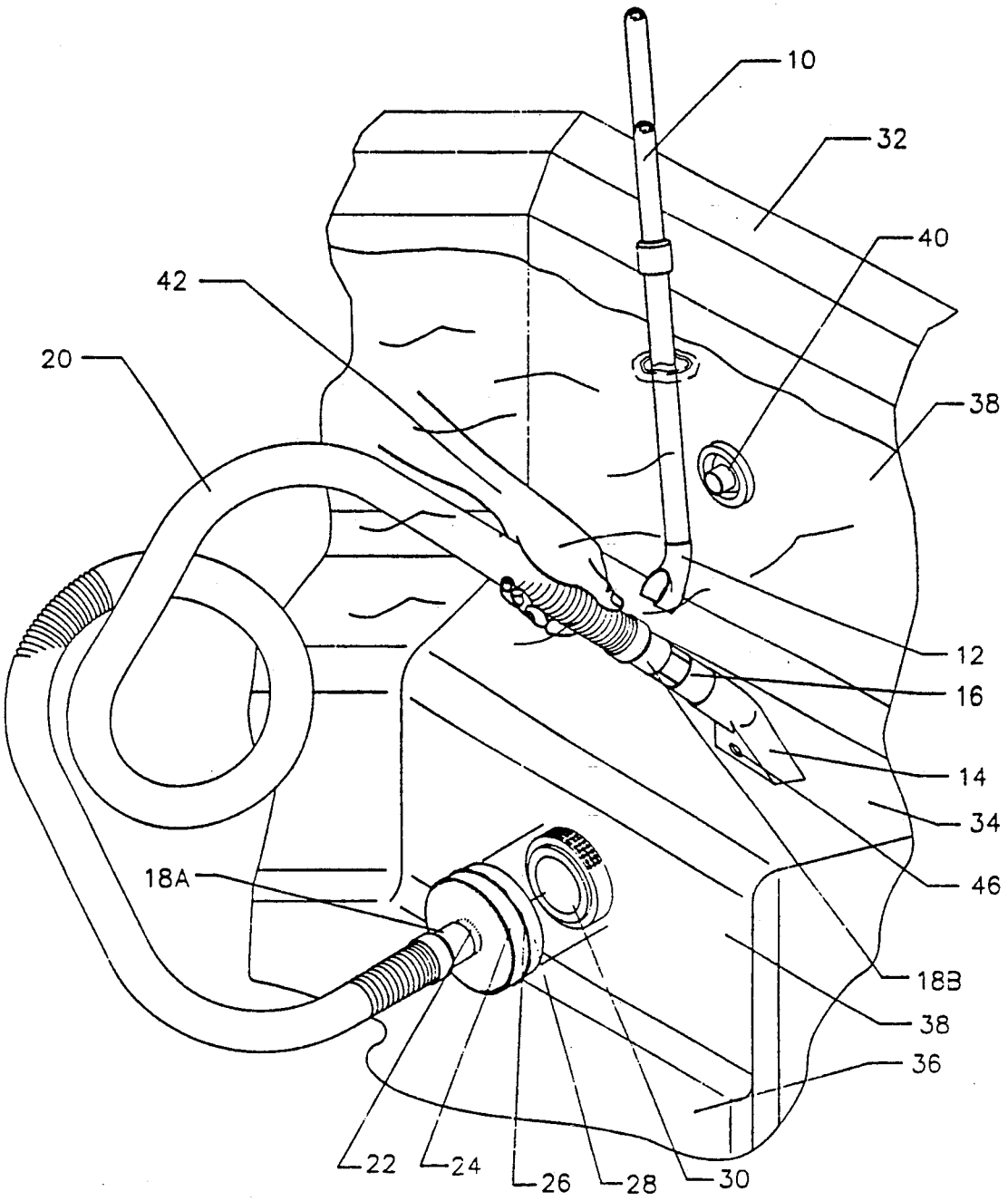
FIG. 1 is a perspective view of a spa, hot tub or like open-topped enclosure, showing the cleaning apparatus in use.

10: telescopic extension pole
12: extension pole connector
14: flat vacuum tool
16: swivel coupling
18A: hose coupling
18B: hose coupling
20: hose
22: hose adaptor
24: hose/filter connector
26: filter
28: outlet cover adaptor
30: existing outlet cover
32: spa, hot tub, or like open-topped enclosure
34: seat
36: floor
38: wall
40: inlet
42: user's hand
44: outlet cover recess
46: relief hole (optional)

DETAILED DESCRIPTION OF THE PREFERRED EMBODIMENTS

A typical embodiment of the present invention is illustrated in FIG. 1. The cleaning apparatus has an outlet cover adaptor 28 of continuous band form designed to enclose an existing outlet cover 30 contained in the spa, hot tub or like open-topped enclosure. A shape of this outlet cover adaptor 28 will resemble the shape of an existing outlet cover 30. The size of an outlet cover adaptor 28 will be larger than an existing outlet cover 30. This allows an outlet cover adaptor 28 to enclose an existing outlet cover 30. Water pressure created by the circulation system will hold the outlet cover adaptor 28 over the existing outlet cover 30. An outlet cover adaptor 28 will be held against the wall 38 or floor 36 depending on the location of the existing outlet cover 30. An outlet cover adaptor 28 couples with a hose/filter connector 24 complete with hose adaptor 22. A hose/filter connector 24 couples with an outlet cover adaptor 28 at an outlet cover recess 44 while supporting a filter 26 between an outlet cover adaptor 28 and a hose/filter connector 24. A hose coupling 18A which connects a hose 20 to a hose adaptor 22 located on a hose/filter connector 24. A hose coupling 18B contains a swivel coupling 16 which connects to a flat vacuum tool 14. A flat vacuum tool 14 may contain an optional relief hole 46. A telescopic extension pole 10 connects to a swivel coupling 16 by means of an extension pole connector 12.

Figure 2:
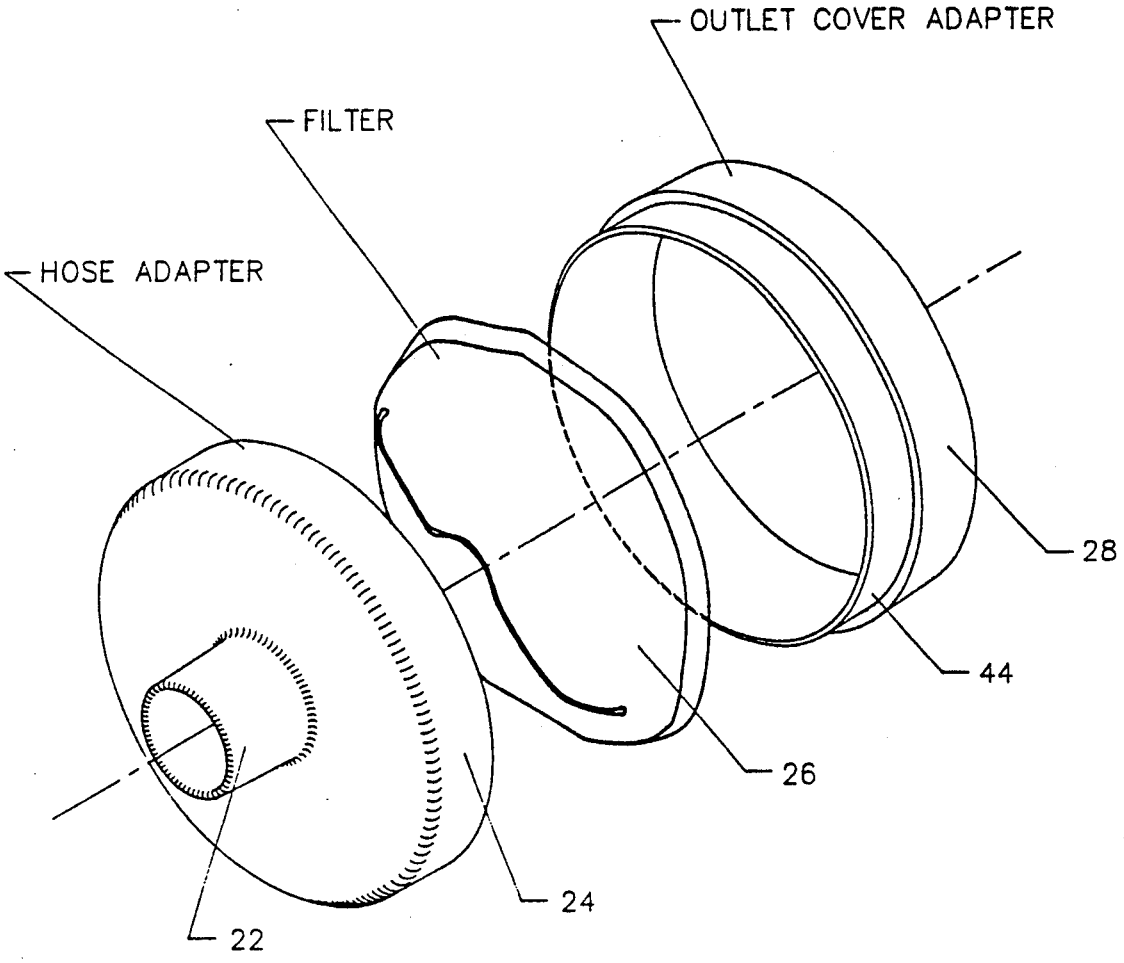
FIG. 2 is a perspective view with parts separated to show the outlet cover adaptor, hose/filter connector and filter.

FIG. 2 illustrates the preferred embodiment of the outlet cover adaptor 28 complete with the outlet cover recess 44. This recess 44 supports a filter 26 and provides a method of coupling to a hose/filter connector 24. A hose/filter connector 24 supplies a hose adaptor 22 to allow connection to a hose coupling 18A.

Figure 3:
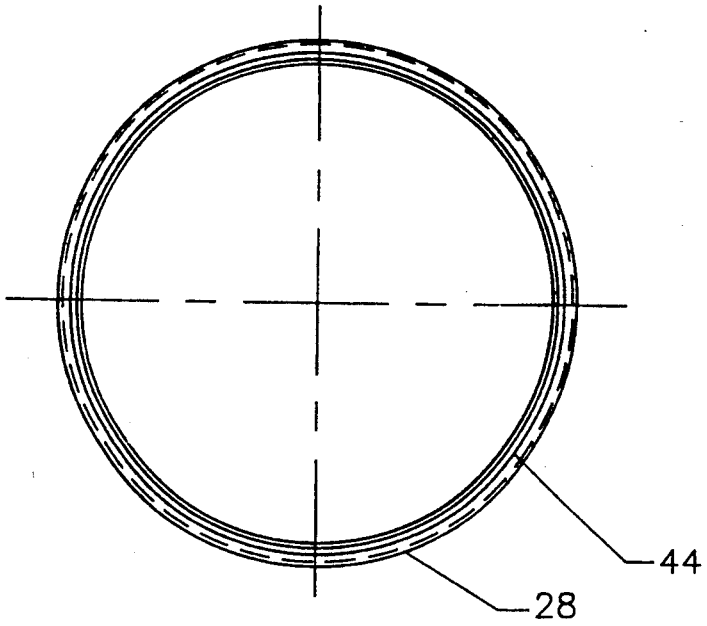
FIG. 3 is a top view of the outlet cover adaptor used to cover the suction outlet contained in spas, hot tubs and like open-topped enclosures.
Figure 4:
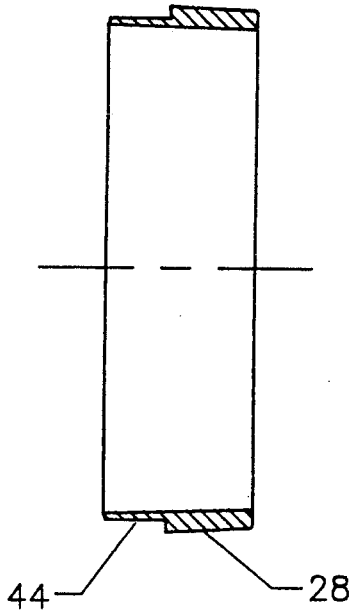
FIG. 4 is a side view of the outlet cover adaptor showing the recess to hold filter and couple to hose/filter connector.

FIG. 3 (top view) and FIG. 4 (side view) illustrates the preferred embodiment of an outlet cover adaptor 28 complete with recess 44.

Figure 5:
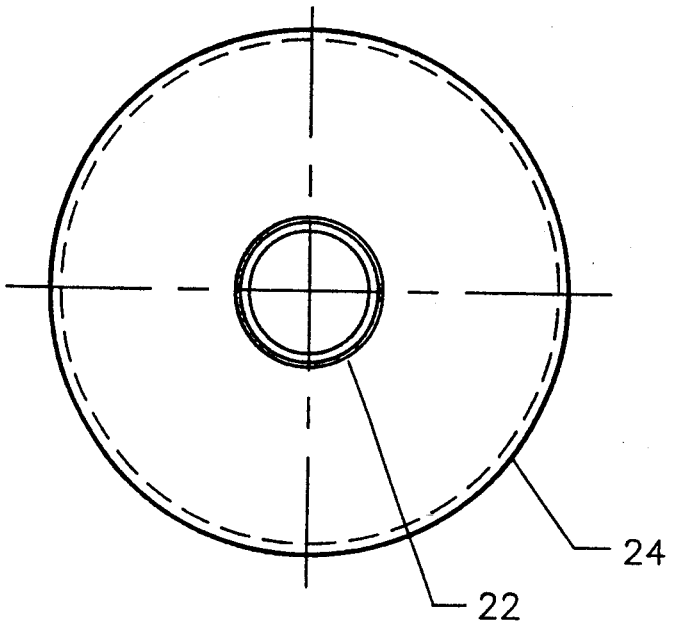
FIG. 5 is a top view of the hose/filter connector showing the press fitted hose connector.
Figure 6:
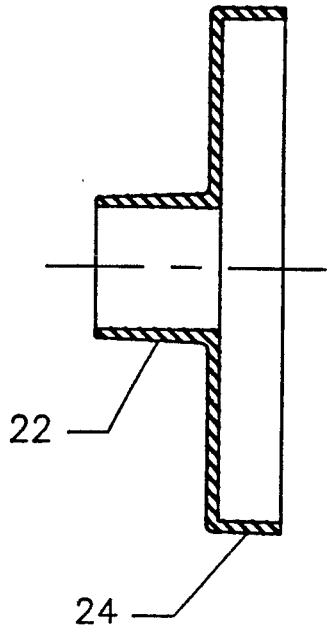
FIG. 6 is a side view of the hose/filter connector.

FIG. 5 (top view) and FIG. 6 (side view) illustrates the preferred embodiments of a hose/filter connector 24 complete with a hose adaptor 22.

From the description above, a number of advantages of my water driven cleaning apparatus for spas, hot tubs and like open-topped enclosures become evident:

(a) The invention can be used in an indoor or outdoor environment.
(b) The invention can be used while in the vessel or outside the vessel.
(c) The invention traps sand, gravel, leaves, needles and other foreign particle before they enter the primary filtration system.
(d) The invention contains a cleanable, reusable, removable and replaceable filter.
(e) The invention operates through the existing circulation system contained in pressurized spas, hot tubs and like open-topped enclosures.
(f) The invention provides consistent vacuum action for as long as needed.
(g) The invention is safe, efficient and easy-to-use.

Operation—FIGS. 1 to 6

The manner of using a cleaning apparatus for spas, hot tubs and like open-topped enclosures to remove sand, gravel, leaves, needles and other foreign matter makes use of the circulation system contained in these pressurized vessels. Namely, one first submerges a cleaning apparatus (FIG. 1) to remove air and fill assembly with water. With the pressurized circulation system operation, an outlet cover adaptor 28 is placed over an existing outlet cover 30. Water pressure will hold the outlet cover adaptor 28 firmly against the spa wall 38 or spa floor 36, depending on the location of an existing outlet cover 30. Vacuum pressure is transmitted through an outlet cover adaptor 28, filter 26, hose/filter connector 24, hose coupling 18A, hose 20, hose coupling 18B, swivel coupling 16, flat vacuum tool 14. The bather can now vacuum sand, gravel, leaves, needles, and other foreign particles which collect on a seat 34, floor 36, and wall 38. The optional relief hole 46 ensures constant water circulation. This feature prevents the possibility of a flat vacuum tool 14 becoming clogged or attached to a surface which may shut-off the flow of water. A relief hole 46 will allow constant circulation of water. The cleaning system may also be operated from outside the spa, hot tub or like open-topped enclosure by use of the telescopic extension pole 10 complete with extension pole connector 12. A pole connector 12 snaps over a swivel coupling 16 to allow the cleaning apparatus to be operated from outside the vessel.

SUMMARY, RAMIFICATIONS, AND SCOPE OF INVENTION

Accordingly, the reader will see that the cleaning apparatus provides a fast, efficient, easy-to-operate system to remove unwanted particles from spas and hot tubs. These particles may include sand, gravel, leaves, needles and any other foreign matter which may collect on the seats, floor or wall of spas and hot tubs. The system is designed to remove these particles BEFORE they enter the primary filtration system. This will increase the life of the primary filter. Furthermore, the cleaning apparatus has the additional advantages in that:

it can be operated from within the spa or hot tub;
it can be operated while outside the spa or hot tub;
it provides consistent vacuum action without pumping or the addition of water to the vessel;
it can be operated by any spas or hot tub user, regardless of physical strength, size or stamina.

Although the description above contains specifications, these should not be construed as limiting the scope of the invention but as merely providing illustrations of some of the preferred embodiments of this invention. For example, the cleaning apparatus can have other shapes, such as square, rectangular, oval, triangular or trapezoidal, with the shape determined by the existing outlet cover; the attachments may include a variety of vacuum tools and extensions such as crevice tools, vacuum tools with brushes or bristles, flat vacuum tools, and like vacuum attachments; these attachments may have relief holes built into the design to prevent blockage of water through the tool,; the filter may be placed in-line at other points within the cleaning system; the filter may be constructed of various materials.

Thus the scope of the invention should be determined by the appended claims and their legal equivalents, rather than by the examples given.

I claim:

1. A cleaning apparatus for cleaning a spa, hot tub or like open-topped water enclosure which contains water, said enclosure having at least one main outlet, defined by a projection, and at least one inlet located therein to circulate the water from the enclosure via a circulation pump, thereby creating suction pressure through the at least one main outlet, said apparatus comprising:

a) an outlet cover adapter of continuous band form defining a passage therethrough having spaced parallel longitudinal ends, one end adapted to fit over the at least one main outlet of the enclosure for detachable engagement therewith, the other end of the outlet cover adapter having a recess around its periphery, b) a filter, c) a connector defining a passage therethrough, said connector having spaced opposite sides, one side defining a broad opening sealingly engaging said recess, said connector sandwiching the filter between the one side and the recess such that said filter completely covers the broad opening, the other side of the connector defining a cylindrical projection having an opening smaller than said broad opening therethrough such that the outlet cover adapter and connector are held in place on the outlet by the suction pressure created by the circulation pump, d) an elongated flexible vacuum hose having one end engaging said cylindrical projection and the other end has coupled thereto a swivel cuff, e) a vacuum tool, said tool comprises an elongated member with a fluid passage therethrough, said member having a fluid inlet at one end fluidly communicating with said passage, said member connected at the other end to the swivel cuff, said cuff allowing rotation of the tool relative to the hose, f) an elongated, telescopic extension pole having a connector at one end, said connector is removably attached to said elongated member, said apparatus utilizing the spa, hot tub or like open-topped water enclosure's circulation pump to generate suction pressure therethrough to remove debris from said enclosure for collection in said filter.

2. The apparatus of claim 1, wherein the filter is a nylon mesh.

3. The apparatus of claim 1, wherein the member has a relief hole therein.

* * * * *